United States Patent [19]

Almouli

[11] 4,427,134

[45] Jan. 24, 1984

[54] AEROSOL DISPENSER CONTAINER AND ACTUATOR THEREFOR

[76] Inventor: Albert A. Almouli, 24 Lipski St., Tel Aviv, Israel

[21] Appl. No.: 279,351

[22] Filed: Jul. 1, 1981

[51] Int. Cl.[3] ..... B67B 5/00

[52] U.S. Cl. ..... 222/153; 222/402.11; 215/201; 220/214

[58] Field of Search ..... 222/153, 402.1, 402.11, 222/402.13, 402.15, 23; 220/85 P, 214; 215/201, 252

[56] References Cited

U.S. PATENT DOCUMENTS 3,158,292 11/1964 O'Donnell ..... 222/402.11
3,272,390 9/1966 Horwitt ..... 222/153
3,888,383 6/1975 Rowlands ..... 215/252 X
4,067,482 1/1978 Vogel et al. ..... 222/153

*Primary Examiner*—David A. Scherbel
*Assistant Examiner*—Michael S. Huppert
*Attorney, Agent, or Firm*—Benjamin J. Barish

[57] ABSTRACT

An aerosol dispenser container includes a blocking tab receivable between the cap actuator element and the nozzle for permitting the depression of the nozzle by the actuator element only upon removal of the blocking tab. The blocking tab is formed, at one end, with a bifurcation straddling the nozzle for blocking its depression, and with a pair of laterally-extending projections engageable with the inner face of the tab for securely holding the blocking tab in place until forcefully removed, these projections being severed upon the forceful removal of the tab to thereby render the container tamper-proof.

9 Claims, 5 Drawing Figures

AEROSOL DISPENSER CONTAINER AND ACTUATOR THEREFOR

BACKGROUND OF THE INVENTION

The present invention relates to aerosol dispenser containers, and particularly to the type which includes an actuator element which is depressable to depress the container nozzle and thereby to produce a discharge of the container contents through the nozzle.

A large number of aerosol dispenser containers of the foregoing type have been designed and are now in use. In order to prevent accidental discharge of the container contents, some of these aerosol dispenser containers include various blocking arrangements which prevent the depression of the nozzle until a blocking element is forcefully removed.

BRIEF SUMMARY OF THE INVENTION

An object of the present invention is to provide an aerosol dispenser container of the foregoing type but including a blocking tab which is securely held in place to thereby prevent accidental actuation of the dispenser, which blocking tab is also severed upon its forceful removal to therey render the dispenser tamper-proof. A further object is to provide an aerosol dispenser container with a blocking tab which may be manufactured and assembled into the container in a simple and inexpensive manner.

According to a broad aspect of the present invention, there is provided an aerosol dispenser container including a nozzle which is depressable to open a normally-closed valve and to produce a discharge of the container contents through the nozzle; and a cap overlying the nozzle and having an actuator element to depress the nozzle to produce the discharge. The container further includes a blocking tab receivable between the cap actuator element and the nozzle for permitting the depression of the nozzle by the actuator element only upon removal of the blocking tab. The blocking tab is formed at one end with a bifurcation straddling the nozzle for blocking the depression thereof by the actuator element and is formed at its opposite end with a finger-gripping element for pulling out the blocking tab to permit depression of the nozzle by the actuator element.

According to a further feature, the blocking tab is also formed, at an intermediate portion, with a pair of projections or ears extending laterally on opposite sides thereof and engageable with the inner face of the cap for securely holding the tab in place until forcefully removed. These laterally-extending projections are connected to the tab by thin interconnecting webs which are severed upon the forceful removal of the blocking tab, thereby rendering the container tamper-proof by this indication of the forceful removal of the blocking tab.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
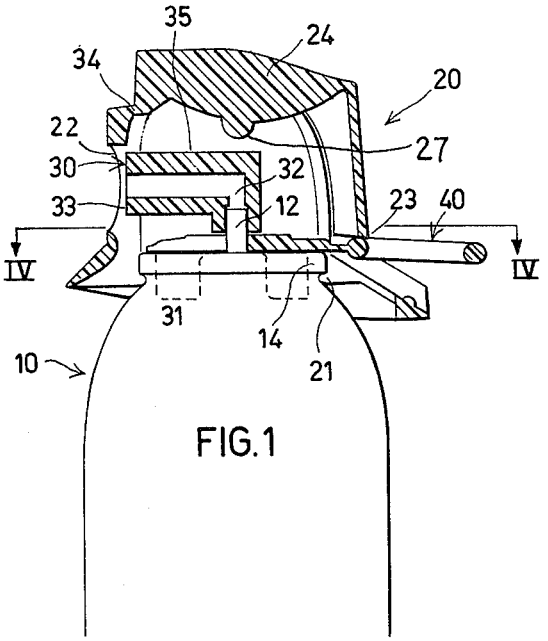
FIG. 1 is a side view, partly in section, illustrating one form of aerosol dispenser container and cap constructed in accordance with the present invention.

The aerosol dispenser illustrated in the drawings comprises a container, generally designated 10, provided at its upper end with a nozzle 12 which is depressable to open the dispenser valve (within the nozzle) and to produce a discharge of the container contents through the nozzle. Such aerosol dispenser containers are well-known, and therefore further details of the construction of the container 10 or its valve nozzle 12 are not deemed necessary herein.

Container 10 includes a cap, generally designated 20, having a depressable element effective to depress nozzle 12, and thereby to open the valve to produce the discharge of the container contents through the nozzle.

Figure 3:
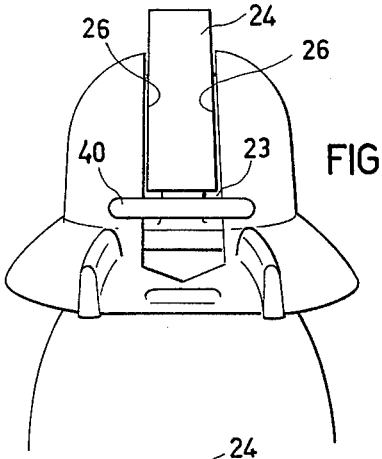
FIG. 3 is a rear view of the cap of FIG. 1.
Figure 2:
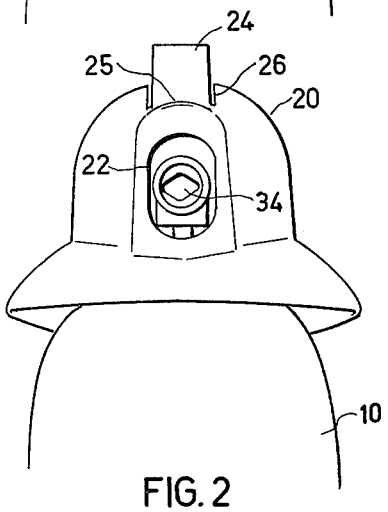
FIG. 2 is a front view of the cap of FIG. 1.

More particularly, actuator cap 20 is in the shape of a firemen's helmet formed with an annular flange 21 on its inner face for mounting to an annular lip 14 at the upper end of the container 10. Cap 20 is formed, on its front face (in FIG. 2), with an opening 22 through which the container contents are discharged, and on its rear face (FIG. 3), with a further opening 23 for receiving a blocking tab, generally designated 40 and to be described more particularly below.

The depressable actuator element in the helmet-shaped cap 20 is in the form of an upper band or bar 24 extending from the front face of the cap, across its top and terminating at its rear face. Bar 24 is integrally secured to the front face of the cap along a thin interconnecting web 25, as shown particularly in FIG. 2, but is otherwise separated from the remainder of the cap by slits 26 extending along opposite sides of the bar to the opening 23 on the rear face of the cap. The inner face of bar 24 is formed with a depending projection 27 (FIG. 1) which is effective, upon the depression of the bar, to also depress nozzle 12 and thereby to effect a discharge of the container contents through the nozzle.

When bar 24 of the cap 20 is depressed, its projection 27 engages a hollow sleeve 30 received on nozzle 12. More particularly, sleeve 30 includes a mounting leg 31 of substantially square cross-section and formed with a hollow bore 32 for mounting same with a press-fit on nozzle 12. Sleeve 30 also includes a right-angle horizontal leg 33 aligned with opening 22 in the cap 20, leg 33 being formed with a bore 34 communicating with bore 32 of the mounting leg 31. The upper face of the horizontal leg 33 underlying the projection 27 of the cap actuator bar 24 is preferably flat, whereas the remainder of the leg may be of cylindrical configuration. In addition, the outer end or mouth of bore 34 may be somewhat diamond-shaped, as shown particularly in FIG. 2, to horizontally spread-out the discharge from the container.

Figure 4:
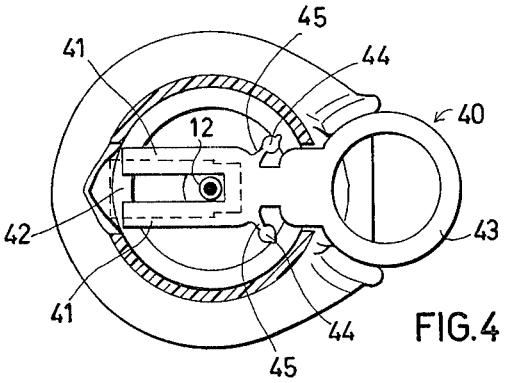
FIG. 4 is a sectional view along lines IV—IV of FIG. 1.
Figure 5:
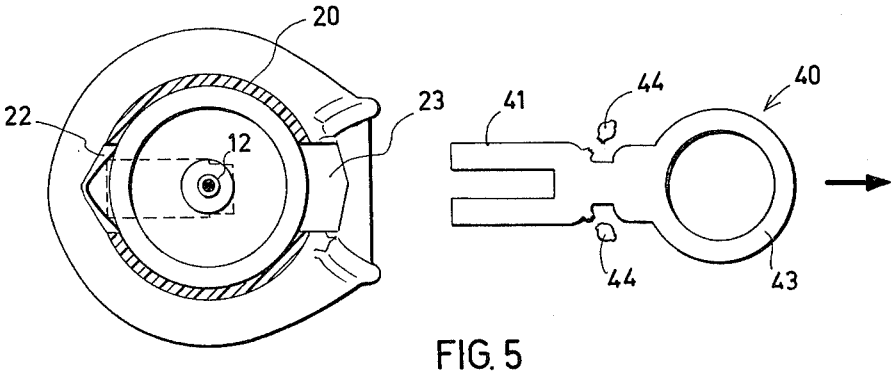
FIG. 5 is a top plan view illustrating the blocking tab after having been forcefully removed in order to permit actuation of the dispenser container.

The blocking tab, generally designated 40, which is effective to block the depression of valve 12 until the tab is removed, is more particularly illustrated in FIG. 4. Thus, one end of the blocking tab 40 is bifurcated, being formed with a pair of legs 41 separated by a space 42. This space is equal to the outer diameter of nozzle 12 so as to permit the bifurcation legs 41 to straddle the nozzle under the mounting leg 31 of the hollow sleeve 30, and thereby to block the depression of the hollow sleeve and of the nozzle so long as the blocking tab is in place.

The opposite end of blocking tab 40 is in the form of a circular ring 43, which ring serves as a finger-gripping element for pulling out the tab whenever the device is to be conditioned for use.

Blocking tab 40 also includes a pair of projections or ears 44 extending laterally from opposite sides of the tab and joined to the intermediate portion of the tab by thin connecting webs 45. Projections 44 are effective to engage the inner face of cap 20, when the blocking tab is in position, to hold the tab in place and thereby to block the actuation of the dispenser. However, when tab 40 is forcefully removed, by pulling on its circular ring 43, webs 45 of the projection 44 are severed, to permit the tab to be pulled out.

The manner of using the aerosol dispenser container illustrated in the drawings will be apparent from the above description. Thus, when originally assembling the aerosol dispenser, the blocking tab 40 is in the position illustrated in FIG. 4, wherein its legs 41 at the bifurcated end of the tab straddle nozzle 12, and the lateral ears or projections 44 at the intermediate portion of the tab engage the inner face of the cap 20, thereby securely holding the tab in blocking position. In this blocking position of tab 40, its circular ring 43 extends through opening 23 of the cap 20, for easy access by the user.

The aerosol dispenser is packaged, stored, handled and sold in this manner, fully protected against accidental operation so long as the blocking tab 40 is in its blocking position, it being securely held in this position by its projections 44 engaging the inner face of the cap 20. Whenever the dispenser is to be actuated, the blocking tab 40 is forcefully pulled out, this also effecting the severing of the webs 45 connecting the projections 44 to the remainder of the tab. Thus, the projections 44 not only serve to securely hold the tab in place to prevent accidental actuation of the dispenser, but also serve to render the dispenser tamper-proof since, once this tab has been removed, its projections 45 will have been severed which will be apparent by the free insertion and removal permitted by the projection-free tab.

While the invention has been described with respect to one preferred embodiment, it will be appreciated that many other variations, modifications and applications of the invention may be made.

What is claimed is:

1. An aerosol dispenser container comprising:

a nozzle which is depressable to open a normally-closed valve and to produce a discharge of the container contents therethrough;

a cap overlying the nozzle and including an actuator element to depress the nozzle to produce said discharge;

and a blocking tab receivable between said cap actuator element and the nozzle for permitting the depression of the nozzle by the actuator element only upon removal of the blocking tab;

said blocking tab being formed at one end with a bifurcation straddling the nozzle for blocking the depression thereof by the actuator element, and being formed at the opposite end with a finger-gripping element for pulling out the blocking tab to permit depression of the nozzle by the actuator element, said blocking tab being further formed at an intermediate portion with a pair of projections extending laterally on opposite sides thereof and enageable with the inner face of the cap for securely holding the tab in place until forcefully removed.

2. The aerosol dispenser container according to claim 1, wherein said laterally-extending projections are connected to said tab by thin interconnecting webs which are severed upon the forceful removal of the blocking tab, thereby rendering the container tamper-proof by this indication of the forceful removal of the blocking tab.

3. The aerosol dispenser container according to claim 1, further including a hollow sleeve removably received over the nozzle and having a right-angle bend at its upper end for effecting a right-angle change in the direction of the discharge from the container.

4. The aerosol dispenser container according to claim 3, wherein the inner face of said cap actuator element is formed with a depending projection engaging the upper face of said hollow sleeve for depressing same and said nozzle, upon depression of the actuator element, in the absence of the blocking tab.

5. The aerosol dispenser container according to claim 4, wherein the upper end of said hollow sleeve has a flat upper face which is engaged by said depending projection on the inner face of the cap actuator element.

6. The aerosol dispenser container according to claim 4, wherein said hollow sleeve includes a mounting leg engageable by the upper face of the bifurcated end of the blocking tab so as to be blocked thereby against depression until the blocking tab has been removed.

7. An aerosol dispenser container according to claim 1, wherein said actuator element of the cap extends across the top of the cap and is integrally connected thereto only by a thin interconnecting web at the front of the cap.

8. The aerosol dispenser container according to claim 1, wherein said actuator cap is in the configuration of a fireman's helmet having an opening through the front face for the discharge of the container contents through the nozzle, and having a further opening in its opposite face for receiving the blocking tab.

9. The aerosol dispenser container according to claim 1, wherein said finger-gripping element at said opposite end of the blocking tab is in the form of a circular ring.

* * * * *